US005733182A

United States Patent [19]

Muramatsu et al.

[11] Patent Number: 5,733,182

[45] Date of Patent: Mar. 31, 1998

[54] ULTRA FLAT POLISHING

[75] Inventors: Tomoaki Muramatsu; Takashi Yoshida, both of Kawasaki, Japan

[73] Assignee: Fujitsu Limited, Kanagwa, Japan

[21] Appl. No.: 354,907

[22] Filed: Dec. 12, 1994

[30] Foreign Application Priority Data

Mar. 4, 1994 [JP] Japan ..... 6-034884

[51] Int. Cl.[6] ..... B24B 5/00

[52] U.S. Cl. ..... 451/289; 451/288; 451/285; 451/388

[58] Field of Search ..... 451/41, 269, 270, 451/271, 285, 289, 290, 288, 388

[56] References Cited

U.S. PATENT DOCUMENTS

| | | | |
|---|---|---|---|
| 4,213,698 | 7/1980 | Firtion et al. | 451/388 |
| 4,270,316 | 6/1981 | Kramer et al. | 451/288 |
| 4,918,869 | 4/1990 | Kitta | 451/288 |
| 5,036,630 | 8/1991 | Kaanta et al. | 451/289 |
| 5,377,451 | 1/1995 | Leoni et al. | 451/290 |
| 5,423,558 | 6/1995 | Koeth et al. | 451/289 |
| 5,441,444 | 8/1995 | Nakajima | 451/289 |

FOREIGN PATENT DOCUMENTS

| | | | |
|---|---|---|---|
| 3134166 | 6/1988 | Japan | 451/289 |

*Primary Examiner*—James G. Smith
*Assistant Examiner*—Dona C. Edwards
*Attorney, Agent, or Firm*—Nikaido, Marmelstein, Murray & Oram LLP

[57] ABSTRACT

A polishing apparatus comprises a pressure container having a first opening at its bottom and being rotatable about an axis perpendicular to a plane of the first opening; a wafer support coupled elastically to the first opening, sealing the first opening hermetically and having a wafer supporting surface; and a lower surface plate disposed underneath the wafer supporting surface and having a polishing surface approximately parallel to the wafer supporting surface. The wafer support may be provided with flatness adjusting means for selectively applying a larger pressure on a region of the wafer held on the wafer supporting surface than a pressure on other region. The flatness adjusting means may comprise a plurality of pressing pins, or may comprise a hollow within the wafer support, a surface plate having elasticity and sealing the hollow, and means for applying pressure to the hollow. Wafer can be polished under uniform pressure applied on the back surface. Flatness of the wafer can be improved.

21 Claims, 8 Drawing Sheets

ULTRA FLAT POLISHING

BACKGROUND OF THE INVENTION a) Field of the Invention

The present invention relates to a wafer polishing apparatus and a polishing method.

b) Description of the Related Art

In manufacturing ultra large scale integrated circuit (ULSI), recently, as its degree of integration is increased, a higher grade accuracy in the flatness of semiconductor wafer is being required. A wafer surface after polishing of, for example, a six-inch wafer, at present, has an unevenness of approximately 2 μm. Unevenness of a surface of 15 mm square, which is a region of a single exposure, is approximately 0.35 μm On the other hand, for polishing a silicon thin film or a silicon-on-insulator (SOI) film on an insulating surface of a ULSI, it is required to process a Si film with a thickness of 0.1 μm by polishing. For limiting a deviation of thickness to less than 10%, a polishing accuracy in thickness of ±0.01 μm becomes necessary. Under this circumstance, it is required for a surface processing of ULSI wafers to limit unevenness of a surface within approximately 0.1 μm.

FIG. 7 shows schematically a polishing apparatus according to prior art technique.

A wafer 101 is attached to a lower surface of an upper surface plate 102. A rotary drive 107 is attached to the upper surface plate 102 with variable angle of coupling. The rotation axis 107 and the upper surface plate 102 are rotatable around a central axis. A lower surface plate 103 is disposed underneath the upper surface plate 102. A polishing cloth 104 is adhered on the upper surface of the lower surface plate 103. The lower surface plate 103 rotates around a central axis of rotation that is parallel to the central axis of rotation of the upper surface plate and positioned outside of the wafer 101.

A nozzle 105 is disposed over the lower surface plate 103. It supplies polishing liquid 106 on the polishing cloth 104.

At the time of polishing, the upper surface plate 102 and the lower surface plate 103 are rotated. While polishing liquid 106 is supplied from the nozzle 105, the wafer is pressed to the polishing cloth 104 with a predetermined pressure by downward displacement of the upper surface plate. The direction of the plane of the upper surface plate follows that of the plane of the lower surface plate. Here, as the upper surface plate 102 rotates, it is also rocked horizontally to the right and left shown in the figure.

FIG. 8 shows a cross sectional view of the upper surface plate of another polishing apparatus according to prior art technique.

On a wafer supporting surface of an upper surface plate 111, a carrier insert 113 formed of foam urethane etc. is disposed. Minute holes 114 are formed in the wafer supporting surface of the upper surface plate 111. From the minute holes 114, water having pressure of 1 to 2 kg/cm$^2$ is supplied to the carrier insert 113. A wafer 110 is brought into close contact with the carrier insert 113 by surface tension of water.

A guide 112 is disposed on the wafer supporting surface. The guide 112 prevents the wafer to slip in the side direction.

At the time of polishing, a fluid such as gas is supplied to the minute holes 114. The fluid gives pressure to the back side of the wafer 110 directly or via water.

In the polishing apparatus shown in FIG. 7, flatness of the upper surface plate 102 and the lower surface plate 103 influences flatness of the wafer 101. It is difficult to give a six-inch wafer a flatness less than 2 μm, though the flatness of the upper surface and the lower surface plate is selected to be less than 1 to 2 μm.

Further, when the wafer supporting surface of the upper surface plate or a polishing surface of the lower surface plate has a small inclination with respect to the axis of rotation, the wafer is pressed partially. Accordingly, a uniform polishing of the wafer surface cannot be achieved.

In the polishing apparatus shown in FIG. 8, an improved flatness is achieved compared to the case of polishing by the apparatus as shown in FIG. 7. This improvement is obtained by a partial application of pressure by a fluid such as gas or pressurized water on uneven parts of the wafer. However, gas or water may leak from the periphery of the wafer, and it is difficult to obtain a uniform pressure over the whole surface of the wafer. Those portions with holes tend to be pressed stronger than other portions.

SUMMARY OF THE INVENTION

An object of the present invention is to provide a polishing technique that enables to improve flatness of a wafer by applying a uniform pressure from back side of the wafer, while polishing the wafer.

According to one aspect of the present invention, there is provided a polishing apparatus comprising a pressure container having an opening at its bottom and being rotatable around an axis perpendicular to a plane of the opening; means for supporting a wafer, coupled elastically to the opening of the pressure container, hermetically sealing the opening and having a wafer supporting surface for supporting the wafer; and a lower surface plate disposed underneath the wafer supporting surface and having a polishing surface approximately parallel to the wafer supporting surface.

The means for supporting wafer may be provided with means for adjusting flatness. It applies comparatively larger pressure selectively on desired portions than on other portions of the wafer that is supported by a wafer supporting surface.

The means for adjusting flatness may comprise a hollow having an opening at its lower side, and an upper surface plate coupled elastically with the opening of the hollow and hermetically sealing the opening. In a different configuration, the means for adjusting flatness may comprise a buffer plate of elastic material having a wafer supporting surface for supporting the wafer, and means for selective applying pressure to specific regions of the buffer plate.

Since means for supporting a wafer is coupled elastically to an opening of a pressure container, the wafer can displace flexibly with respect to the pressure container. Accordingly, in rotating the wafer centering the rotary axis disposed to a pressure container, the wafer can be pressed in parallel against a polishing surface, even when the axis of rotation is slightly inclined with respect to the polishing surface.

By sealing the opening of the pressure container by the means for supporting the wafer, pressure within the pressure container can be adjusted. Thus, the wafer can be pressed with a desired pressure against the polishing surface.

By selectively applying pressure on specific portions of the wafer, the wafer can be polished diminishing unevenness of the surface of the wafer.

Thus, a surface of a wafer to be polished can be adjusted to contact in parallel with a polishing cloth. An optimum pressure can be applied corresponding to uneven surface of the wafer. Therefore, the wafer can be polished more evenly.

DESCRIPTION OF THE PREFERRED EMBODIMENTS

Figure 1:
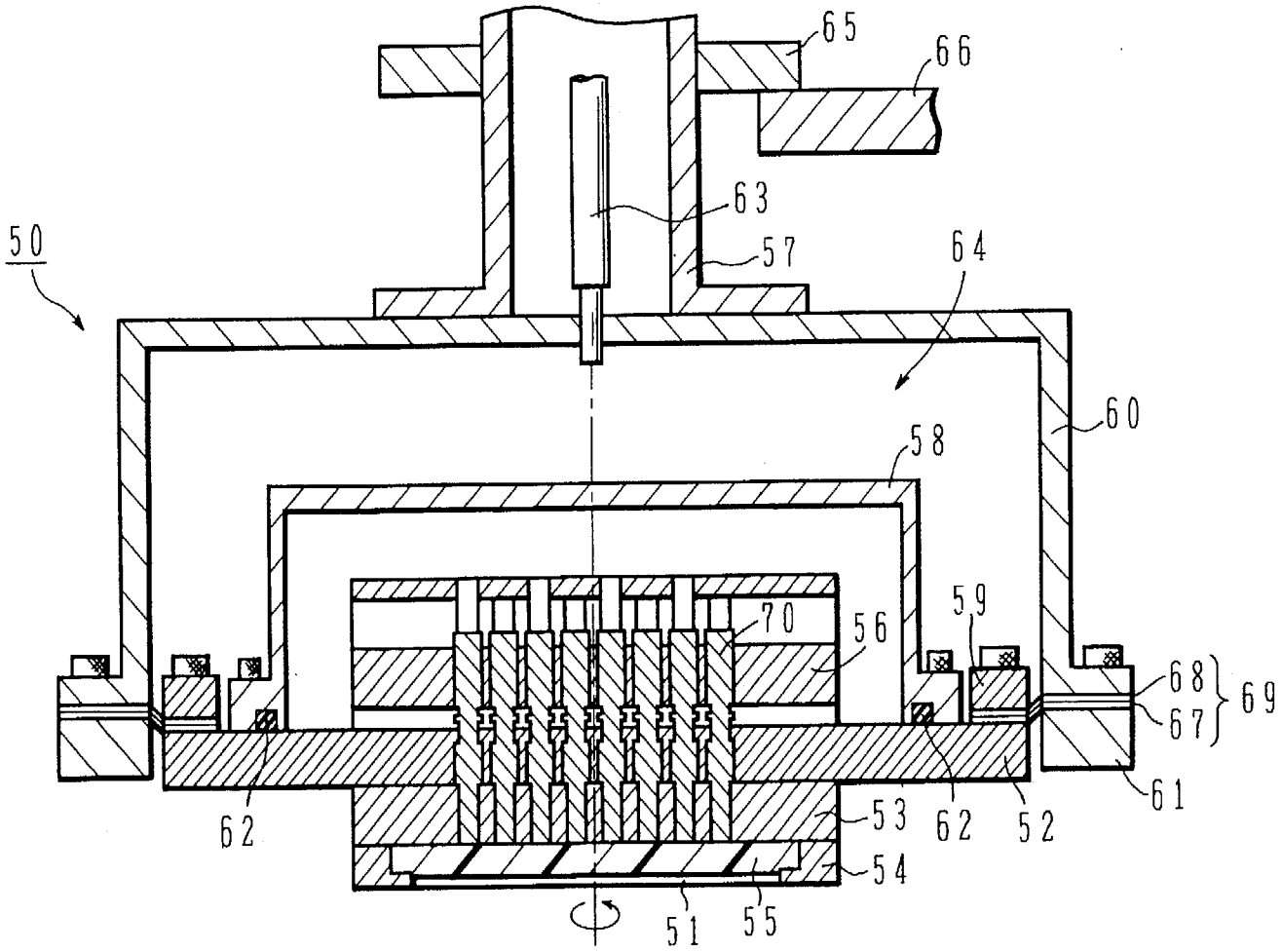
FIG. 1 is a cross sectional view of an upper surface plate member of a polishing apparatus according to a first embodiment of the present invention.

FIG. 1 shows a cross sectional view of an upper surface plate member 50 according to an embodiment.

A substrate holder fixing plate 52 covers an opening of a pressure container 60. A substrate holder 53 is disposed on a lower surface of the substrate holder fixing plate 52. A buffer plate 55 is securely attached on a lower surface of the substrate holder 53. The periphery of the buffer plate 55 is pressed and fixed by a guide 54. The buffer plate 55 is a plate formed of, for example, hard rubber or teflon with a thickness of several mm. A wafer 51 is adhered to the lower surface of the buffer plate using surface tension of water. The periphery of the wafer 51 is received and positioned by the guide 54 for preventing dislocation in side directions.

A plurality of holes is disposed through the substrate holder fixing plate 52 and through the substrate holder 53. Each of the plurality of holes accommodates a pin 70 inserted therein. The lower end of the pin 70 approximately touches the buffer plate 55.

A pin adjusting plate 56 is disposed on the upper surface of the substrate holder fixing plate 52. At positions of the pin adjusting plate 56 aligned with the pins 70, holes having screw thread inside are formed. The pins 70 are inserted into the holes. Screw thread formed on the pin 70 and the inner screw thread formed on the hole fit to each other.

Figure 2A:
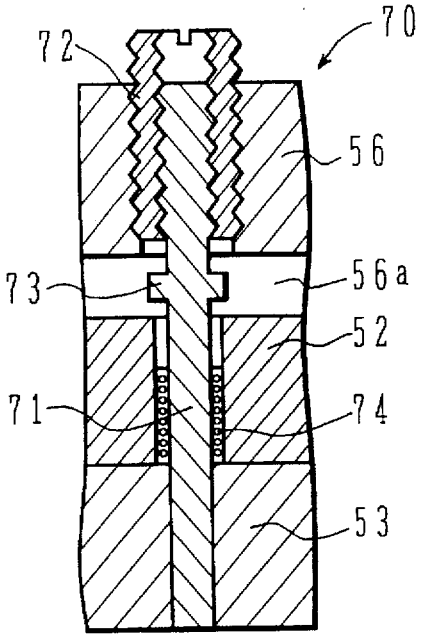
FIGS. 2A and 2B is a cross sectional view of a pin of the upper surface plate member and a bottom view of the upper surface plate member as shown in FIG. 1.

FIG. 2A shows a detailed cross sectional view of the pin 70.

The pin 70 comprises a central axis member 71, a cylindrical screw 72, a rotation stopper 73, and a coil spring 74. The central axis member 71 is inserted into holes formed in the substrate holder fixing plate 52, the substrate holder 53, and the pin adjusting plate 56. The cylindrical screw 72 has screw threads on both of the inner and outer surfaces thereof. The outer screw thread fits with an inner screw thread formed on the inner surface of the hole formed in the pin adjusting plate 56. The inner screw thread fits with a screw thread formed at an upper part of the side surface of the central axis member 71.

The central axis member 71 is provided with a rotation stopper 73 engaging with an engaging surface 56a of the pin adjusting plate 56. The stopper prevents rotation.

Pitches of screw threads on the inner surface and on the outer surface of the cylindrical screw 72 have a slight difference to each other. Therefore, when the cylindrical screw 72 is rotated, the central axis member 71 is dislocated according to the difference of the pitch. Thus, the central axis member 71 can be moved slightly in vertical direction.

A coil spring is disposed in a gap between the inner wall of the hole formed in the substrate holder fixing plate 52 and the central axis member 71. The spring biases the central axis member continually to upward. This mechanism prevents a backlash of the central axis member 71 while displacing.

Returning to FIG. 1, description will be given on the upper surface plate member 50. The periphery of the substrate holder fixing plate 52 is connected to a surface of the opening of a, pressure container 60 with a laminate member 69 comprising a metallic plate spring 67 and a rubber sheet 68 in such a way that a side having the substrate holder 58 faces outside. The laminate member 69 is fixed, on the side of the substrate holder fixing plate 52, with a fixing ring 59 to the periphery of the substrate holder fixing plate 52. The laminate member 69 is fixed, on the side of a pressure container 60, with a fixing ring to an end surface of opening of the pressure container 60. A covering member 58 is disposed on the substrate holder fixing plate 52 in such a way to cover the pin adjusting plate 56 and the pins 70. Contact surfaces of the covering member 58 and the substrate holder fixing plate 52 are sealed hermetically with an O ring 62.

Thus, the pressure container 60 and the covering member 58 Form a hermetic pressurized space 64 therebetween.

A tube 63 for introducing fluid and applying pressure to the pressurized space 64 is connected to approximately the center of the upper side of the pressure container 60. A hollow rotary axis 57 for accommodating the tube 63 inside is connected to the upper side of the pressure container 50 along the central axis of the substrate holder 53.

A stopper 65 projecting from outer side surface of the rotary axis is provided at a predetermined level of the rotary axis 57. The upper surface plate member 50 and the rotary axis 57 is vertically movable. When the stopper 65 touches a block 66, the upper surface plate member 50 is supported and prevented to move further downward.

Figure 2B:
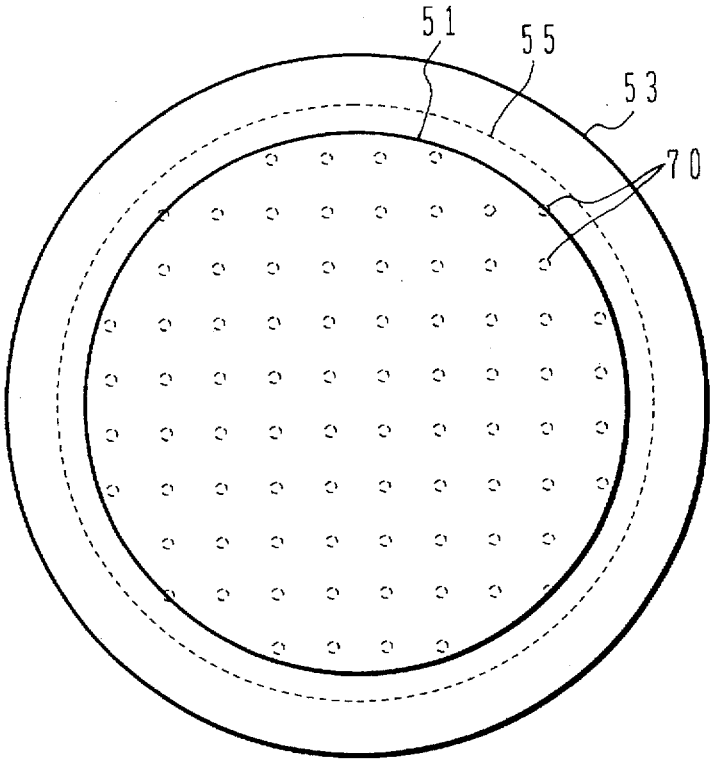

FIG. 2B shows a bottom view of the upper surface plate member. The pins 70 are distributed in a lattice or matrix configuration over the whole surface of the buffer plate 55 almost uniformly. For example, a pitch between the pins in vertical and transverse directions is approximately 10 mm.

Figure 3:
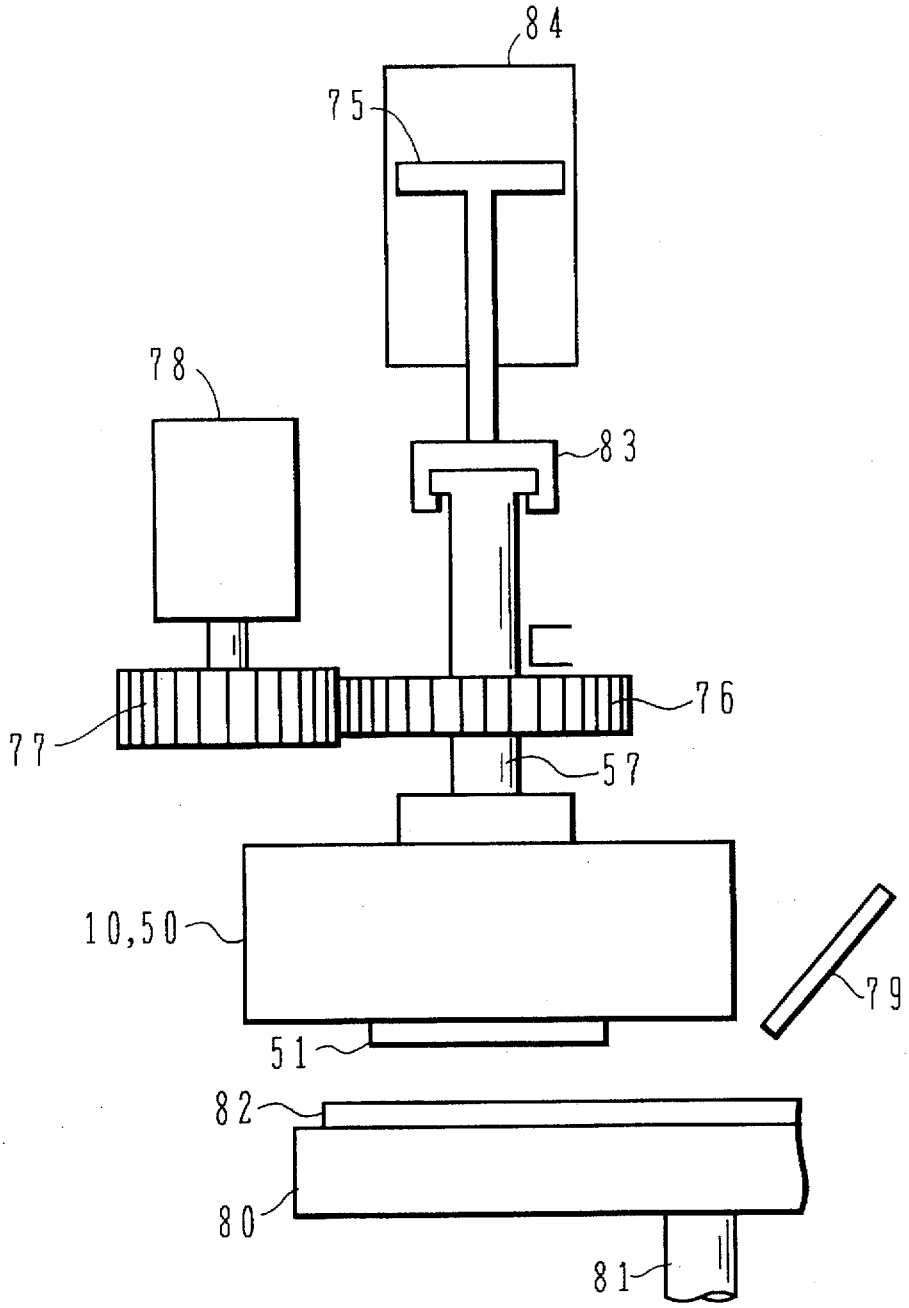
FIG. 3 is a schematic side view of a polishing apparatus according to an embodiment of the present invention.

FIG. 3 shows a schematic diagram of a polishing apparatus.

The upper end of the rotary axis 57 attached to the upper surface plate member 50 shown in FIG. 1 is rotatably supported by an upper supporting member 83. The upper supporting member 83 is connected to a piston 75 accommodated in a cylinder 84. As the piston 75 is driven up and down vertically, the upper surface plate member 50 moves up and down vertically.

The rotary axis 57 has a gear 76 provided coaxially thereon. The gear 76 engages with a gear 77 connected with a motor 78. The motor 78 transmits a rotating power to the rotary axis 57.

A lower surface plate 80 is disposed beneath the upper surface plate member 50. The lower surface plate 80 is rotatable around a rotary axis 81 deviated from the rotation center of the upper surface plate 50. The wafer 51 to be polished is disposed not to overlap the rotary axis 81.

Next, process of polishing a wafer using the polishing apparatus as shown in FIGS. 1 through 3 is described below. An $SiO_2$ film with a thickness of 1 μm formed on a surface of a six-inch Si wafer is to be polished to a thickness of 500 nm.

All of the lower ends of the pins 70 shown in FIG. 1 are positioned at the plane of the lower surface of the substrate holder 53. A wafer 51 is attached to the buffer plate 55 with its surface to be polished or its surface of an oxide film facing downward using surface tension of water. At this stage, the substrate holder fixing plate 52 stays, due to its own weight, approximately a few mm lower than the surface of opening of the pressure container. Air is supplied via the tube 68 to the pressurizing space 64 to obtain an inner gauge pressure, for example, of 0.05 to 0.10 $kg/cm^2$.

Figure 8:
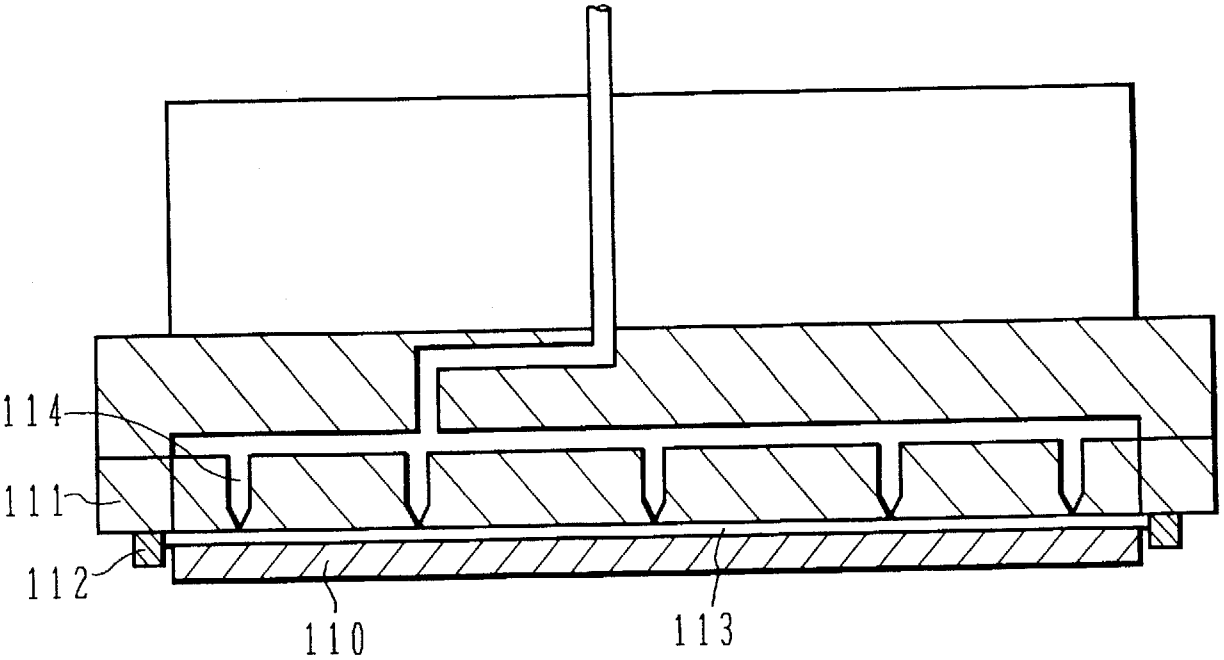
FIG.8 (PRIOR ART)
FIG. 8 is a schematic diagram of an upper surface plate of another polishing apparatus according to prior art.

The lower surface plate 80 shown in FIG. 8 is rotated. Polishing liquid is supplied on the polishing cloth 82 via a nozzle 79. The upper surface plate 50 is moved downward while being rotated. The surface of the wafer 51 to be polished touches the polishing cloth 82 and is subjected to polishing for a predetermined time.

Figure 7:
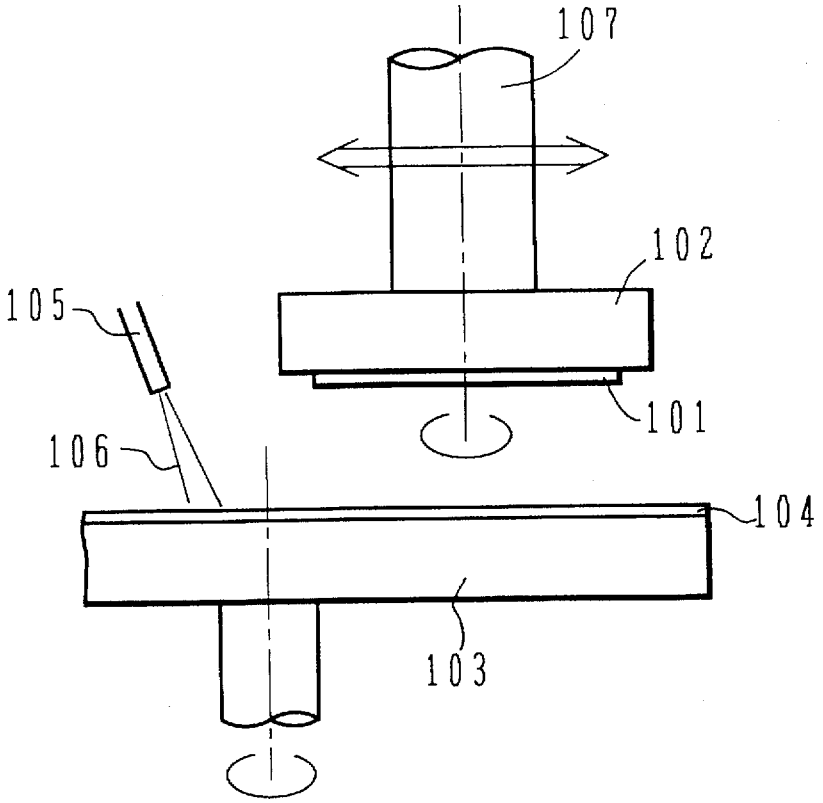
FIG.7 (PRIOR ART)
FIG. 7 is a schematic diagram of a polishing apparatus according to prior art.

The substrate holder fixing plate 52 having the wafer fixed thereon is connected to the pressure container 60 through a laminated plate 69 including a plate spring. Thereby, the orientation of the surface to be polished can be changed flexibly to a certain degree. Thus, the surface of the wafer 51 to be polished can contact the polishing cloth substantially in parallel, even when a central axis of rotation of the upper surface plate 50 is slightly inclined from a direction perpendicular to the polishing cloth. Accordingly, while a polishing by a polishing apparatus according to prior art technique shown in FIG. 7 gave a dispersion in thickness of the $SiO_2$ film of ±100 nm, an improvement to a dispersion of ±50 nm is observed in the case of the present embodiment.

The $SiO_2$ film polished by the above process still has a minute dispersion of film thickness. Next, the pins 70 shown in FIG. 1 corresponding to portions having a large thickness of the $SiO_2$ film is adjusted to move downward. End portions of the pins 70 press the upper surface of the buffer plate 55. Pressure from the pins 70 to the buffer plate 55 diverges to a wider region as the pressure in the buffer plate is transmitted downward. A second polishing is performed in this condition. Portions with a large thickness of the $SiO_2$ film receive a larger pressure applied thereon, and polished faster than other region. Thus, those portions of the $SiO_2$ film having a large film thickness are subjected to a heavier polishing, which gives a result of more uniform film thickness. A dispersion of thickness less than ±25 nm is observed for an $SiO_2$ film after polishing by the process described above.

According to this embodiment, even when a slightly wavy shape is formed on a surface of a wafer to be polished, vertical position of the pin 70 can be adjusted corresponding to distribution of wavy shape. By adjusting pressure of each portion of polishing surface of the wafer, polishing with a uniform thickness of $SiO_2$ film can be attained.

When pressure is applied on a wafer directly by a pin 70 without providing a buffer plate 55, a pressure is applied concentrately only on a small region directly under the pin 70. By inserting a buffer plate 55 and applying pressure of the pin via the buffer plate 55 to the wafer, the pressure is dispersed and applied also to wafer regions on a periphery of the region just beneath the pin 70.

When a harder buffer plate 55 is employed, pressure applied by the pin 70 is dispersed on a wider region. When a softer buffer plate is employed, pressure is concentrated on a narrower region. Accordingly, it is preferable to suitably select a hardness for the buffer plate 55, a pitch of distribution of the pins 70, etc., in accordance with a degree of flatness to be required.

In the embodiment described above, pressure of polishing is usually applied by weights of the upper surface plate member 50 and the rotary axis 57 etc., and a pressure of downward motion of the piston 75. The upper surface plate member 50 may be moved downward gradually, and may maintain a level defined by the point of contact of the stopper 65 and the block 66 as shown in FIG. 1, which is a level of contact of the surface to be polished of the wafer 51 with the polishing cloth. In this case, weights of the rotary axis 57 and the upper surface plate member do not affect pressure of polishing. Pressure of polishing can be applied only from pressure of the fluid introduced into the pressurizing space 64. Thus, an easy control on the pressure of polishing can be attained.

Next, referring to FIGS. 4, 5A and 5B, a second embodiment of the present invention will be described.

Figure 4:
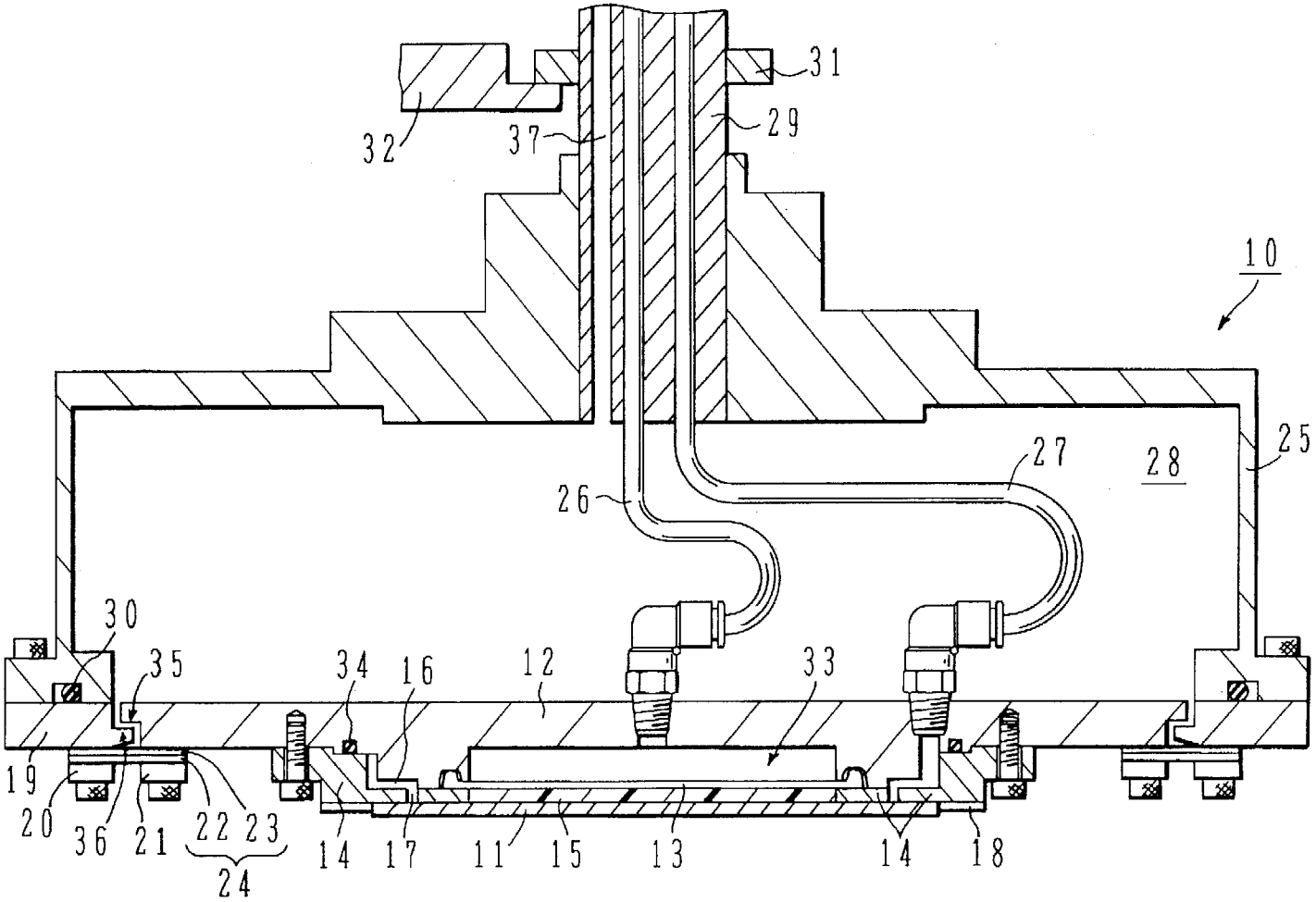
FIG. 4 is a cross sectional view of an upper surface plate member of a polishing apparatus according to a second embodiment of the present invention.

FIG. 4 shows a cross sectional view of an upper surface plate member 10 of a polishing apparatus according to the second embodiment.

An upper substrate holder 12 is positioned at the opening of a pressure container 25 which is similar to the pressure container 60 of FIG. 1. A circular hollow 33 having a smaller diameter than a wafer to be polished is formed at substantially central portion in a lower surface of the upper substrate holder 12. Opening of the hollow 33 is covered by a rubber sheet 13. Peripheral portion of the rubber sheet is pressed and fixed to the upper substrate holder 12 by a lower substrate holder 14. Thus, inside of the hollow 33 is sealed hermetically. A disk-shaped upper surface plate 15 having a diameter approximately equal to that of the hollow 33 is adhered to the lower surface of the rubber sheet 13 by an adhesive, or the like. The upper surface plate 15 is formed of hard rubber having a thickness of several mm. The lower surfaces of the upper surface plate 1.5 and the lower substrate holder 14 are substantially set to lie on the same plane and form a wafer holding surface.

A tube 26 for applying pressure is connected to the hollow via a hole formed through the upper substrate holder 12. A cavity inside the hollow 33 can be pressurized by introducing a gas inside the hollow 33 via the pressurizing tube 26.

A wafer 11 is stuck to the wafer supporting surface formed by the lower surfaces of the upper surface plate 15 and the lower substrate holder 14 by surface tension of water or by vacuum suction. A guide 18 projecting from the wafer supporting surface by a length smaller than the thickness of the wafer 11 is disposed around the periphery of the supported wafer 11. The guide 18 positions the wafer 11 within the wafer supporting surface. The wafer 11 is fixed and prevented its displacement in horizontal direction.

A circular vacuum hole 17 is disposed on the wafer supporting surface of the lower substrate holder 14. The vacuum hole 17 is connected to a vacuum tube 27 via a gap 16 between the upper substrate holder 12 and the lower substrate holder 14. By a suction from the vacuum tube 27, the wafer 11 can be attached to the wafer supporting surface by vacuum suction. Contact surface outside the gap 16 is sealed by an O ring 34. A plurality of suction holes may be employed instead of a circular hole 17.

A ring 19 is disposed at end portion of the opening of the pressure container 25 sandwiching an O ring 30.

The periphery of the upper substrate holder 12 is connected to the ring 19 through a laminated member 24 of a metallic leaf or sheet spring 22 and a rubber sheet 23 in such a way that the lower substrate holder faces outside. The laminated member 24 is fixed, on the side of the upper substrate holder 12, to the periphery of the upper substrate holder 12 with a fixing ring 21, and is fixed, on the side of the ring 19, to the lower surface of the ring 19 with a fixing ring 20.

The upper half of the outer side surface of the upper substrate holder 12 has a projecting part 35 that is slightly projected horizontally from the lower half. The lower half of the inner side surface of the ring 19 has a projecting part 36 that is slightly projected horizontally from the upper half. The projecting parts 35 and 36 formed respectively on the outer periphery of the upper substrate holder 12 and on the inner periphery of the stopper ring 19 are disposed to engage each other. The projecting parts are not in contact, usually. When a downward force is exerted on the upper substrate holder 12, the laminate member 24 is deformed and the upper substrate holder 12 moves downward.

With a large displacement of the upper substrate holder 12, the projecting part 35 touches the projecting part 36. The upper substrate holder 12 does not move further downward. The projecting parts 35 and 36, thus, facilitate as stopper of displacement of the upper substrate holder 12.

A hermetic pressurizing space 28 is formed with the pressure container 25 and the upper substrate holder 12. A rotary axis 29 is connected to the upper surface of the pressure container 25 registered with the central axis of the upper substrate holder 12. The rotary axis 29 houses the pressurizing tube 26 and a vacuum suction tube 27. The tubes 26 and 27, then, are derived outside. The rotary axis 29 further has a guide path 37 of pressurizing gas. The guide path 37 opens to the pressurizing space 28.

A stopper 31 projects at a predetermined level from the outer-side surface of the rotary axis 29. As in the case shown in FIG. 1, when the stopper 31 touches a block 32 fixed outside as result of a vertical displacement of the upper surface plate member 10, the upper surface plate member 10 is supported there at and prevented from further downward displacement.

The polishing apparatus using the upper surface plate member 10 shown in FIG. 4 has a similar configuration as the apparatus shown in FIG. 3. The only difference is the upper surface plate member 10 in FIG. 4 that replaced the upper surface plate member 50 in FIG. 3.

Hereunder, process of polishing a wafer of a polishing apparatus using an upper surface plate member 10 as shown in FIG. 4 is described. An $SiO_2$ film with a thickness of 1 μm formed on a surface of a six-inch Si wafer is to be polished to a thickness of 300 nm.

First, surface of the wafer is polished by applying a pressure to the pressurizing space 28, similar to the case of FIGS. 1 to 3. In this embodiment, similar to the embodiment in FIG. 1, the upper substrate holder fixing plate 12 having the wafer 11 adhered thereon is connected to the pressure container with a laminated plate, 24 including, a leaf or sheet spring. Thus, the surface of the wafer 11 to be polished can touch the polishing cloth substantially in parallel.

Figure 6:
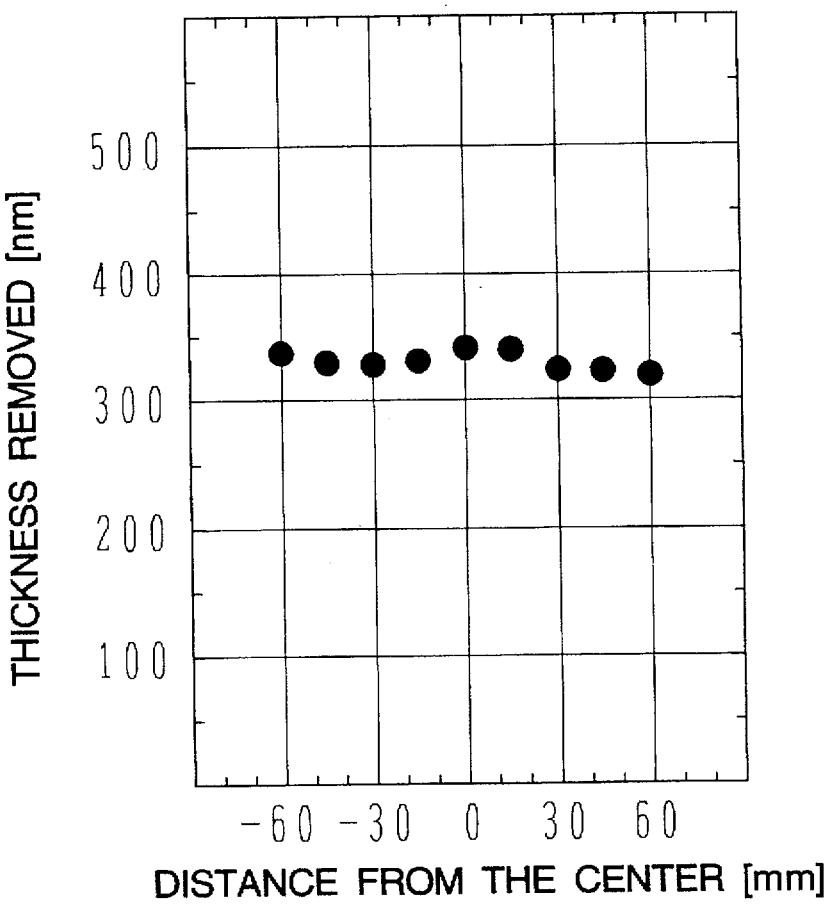
FIG. 6 is a graph showing amount of removal of $SiO_2$ film versus distance from the center of a wafer when an $SiO_2$ film formed on a six-inch Si wafer surface is polished by approximately 300 nm.

FIG. 6 shows a graph of the amount removed from $SiO_2$ film versus the distance from the center of the wafer when an $SiO_2$ film with a thickness of 1 μm formed on a surface of a six-inch Si wafer is polished by a thickness of 300 nm. Abscissa represents the distance from the center of the wafer in mm. Ordinate represents the thickness of removed $SiO_2$ film in nm. As is shown in the graph, dispersion of thickness of the polished $SiO_2$ film was ±15 nm.

This result of an experiment allows a following estimation. For a case of polishing 500 nm of $SiO_2$ film to obtain a remaining $SiO_2$ film with a thickness of 500 nm, it can be estimated that the dispersion of the thickness of $SiO_2$ Film will be around ±25 nm. Accordingly, a dispersion of thickness of the $SiO_2$ film can be expected to be improved from ±100 nm to ±25 nm.

The outer periphery of a wafer is polished faster and has a larger resistance compared to the inner, central portion. Thus, when a wafer is polished while applying a pressure uniformly on the whole surface from the back of the wafer, the outer periphery of the wafer is polished more than the central portion. This is a cause of a tendency of the polished surface to have a convex shape with a larger thickness around the center. When there is a dispersion in pressure applied on respective portions of the surface to be polished, a fine wavy ups and downs may be formed on the polished surface. A process of further polishing the polished surface formed to have a convex shape or a wavy shape will be described hereunder.

Figure 5A:
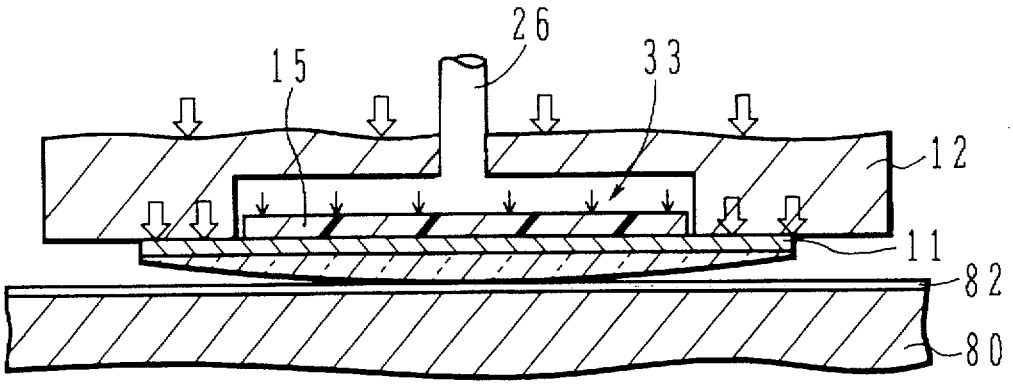
FIGS. 5A and 5B are cross sectional views of an upper surface plate member, a lower surface plate member, and a wafer illustrating a method of polishing the wafer by the polishing apparatus using the upper surface plate member as shown in FIG. 4.

FIG. 5A illustrates a method of polishing when the polished surface of the wafer became convex. The hollow 33 is pressurized by introducing a gas from the pressing tube 26. The pressure is transmitted mainly to the central convex portion of the wafer via the rubber sheet 13 disposed at the opening of the hollow 33 and the upper surface plate 15. Therefore, the central portion is polished more. The flatness of the polished surface is enhanced. In this case, the upper surface plate is preferably of a relatively hard material such as ceramics or fluorine based resin.

Figure 5B:
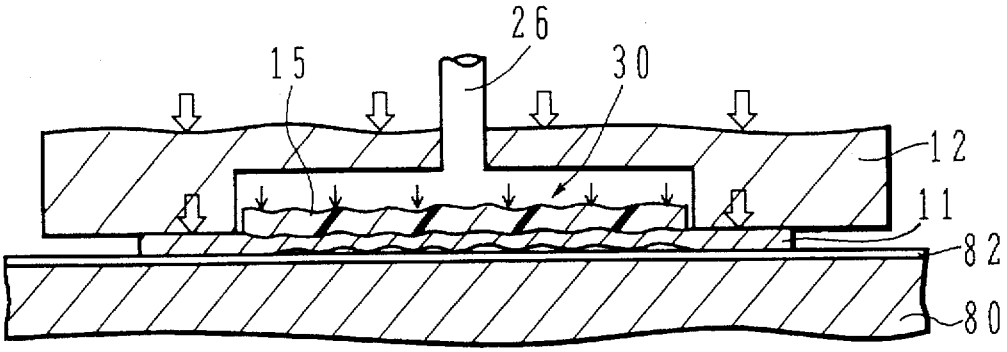

FIG. 5B illustrates a method of polishing when the polished surface of the wafer has a wavelike or corrugated shape. The upper surface plate is preferably of a relatively soft material such as rubber sheet. The hollow 33 is pressurized similarly as in FIG. 5A. The upper surface plate 15 is pressed on the back surface of the wafer 11 by the pressure inside the hollow 33. Here, since the upper surface plate 15 is relatively soft, the upper surface plate 15 is deformed according to the corrugated shape of the back side of the wafer and applies a pressure for polishing. Thus, the surface to be polished is polished applying a more uniform pressure. This process improves the flatness of the polished surface.

Thus, by adjusting hardness of the upper surface plate and pressure within the hollow suitably, an appropriate pressure corresponding to a state of unevenness of the surface to be polished can be applied to the wafer. Therefore, a more flat polishing can be achieved.

Moreover, in this embodiment, adjustment of displacing the plurality of pins 70 as shown in FIG. 1 is not necessary. As a wafer becomes large in size, the number of pins 70 becomes large accordingly. It becomes more difficult to adjust the displacements of all the pins adequately. However, in this embodiment, the only points of adjustment for a larger wafer size are mainly pressures of the pressing space 28 and of the hollow 33. This merit gives another effect of easier adjustment for an optimum condition of polishing.

Here, in the above first and second embodiments, description has been given for the case of driving a vertical displacement of the upper surface plate member using a cylinder and a piston. Other driving method can be employed. For example, a linear driving method using a motor or a linear guide can be employed.

Although the present invention has been described on preferred embodiments, the present invention is not limited thereto. It will be apparent for those skilled in the art that various changes, substitutions, modifications, combinations and improvements can be made within the scope and spirit of the appended claims.

We claim:

1. A polishing apparatus comprising:

a pressure container having a first opening at its bottom and being rotatable around an axis perpendicular to a plane of said first opening;

means for supporting a wafer, coupled elastically to the first opening of said pressure container, hermetically sealing said first opening, and having a wafer supporting surface for supporting a wafer, said means for supporting a wafer including flatness adjusting means for selectively applying a larger pressure on a large pressure region of a wafer supported on said wafer supporting surface so as to define a large pressure region and a non-large pressure region; and a lower surface plate disposed underneath said wafer supporting surface and having a polishing surface approximately parallel to said wafer supporting surface.

2. A polishing apparatus according to claim 1 wherein said means for supporting a wafer includes a laminate of a first rubber sheet and a metal sheet spring, attached to said first opening.

3. A polishing apparatus according to claim 1 wherein said flatness adjusting means comprises:

a hollow member having a second opening underneath; and an upper surface plate attached elastically to said second opening of said hollow member and hermetically sealing said second opening.

4. A polishing apparatus according to claim 3 wherein said upper surface plate comprises a second rubber sheet, and a plate member adhered to lower surface of said second rubber sheet.

5. A polishing apparatus according to claim 4 wherein said plate member is a ceramic plate, a fluorine based resin plate, a teflon plate, or a rubber plate.

6. A polishing apparatus according to claim 4 wherein said means for adjusting flatness further comprises upper surface plate fixing means for fixing periphery of said second rubber sheet by pressing the periphery to periphery of said second opening of said hollow member, and thus upper surface plate fixing means has a lower surface constituting a part of said wafer supporting surface.

7. A polishing apparatus according to claim 6 wherein said wafer supporting surface of said upper surface plate fixing means is provided with a vacuum hole for sucking and supporting a wafer.

8. A polishing apparatus according to claim 4 wherein said means for supporting a wafer comprises a laminate of a sheet spring and a first rubber sheet attached to said first opening.

9. A polishing apparatus according to claim 3 further comprising another means for supplying a pressurized fluid into said hollow member.

10. A polishing apparatus according to claim 1 further comprising a stopper mechanism for preventing a displacement of said means for supporting a wafer beyond a first amount relative to said pressure container.

11. A polishing apparatus according to claim 1 further comprising means for supplying a pressurized fluid into said pressure container.

12. A polishing apparatus according to claim 1 further comprising:

drive means for relatively changing distance between the wafer supporting surface of said means for supporting a wafer and the polishing surface of said lower surface plate; and a stopper mechanism for limiting relative position of said means for supporting a wafer and said lower surface plate when the surface of a wafer to be polished supported by said wafer supporting surface contacts said polishing surface.

13. A polishing apparatus according to claim 1 wherein said means for adjusting flatness comprises:

a buffer plate formed of an elastic material having a wafer supporting surface for supporting a wafer on the lower surface thereof; and means for selectively pressing specific region of said buffer plate.

14. A polishing apparatus according to claim 13 wherein said selective pressing means comprises a multiplicity of pins having their lower ends being capable of touching a back surface of said buffer plate and displacing downward to apply pressure on the back surface of said buffer.

15. A polishing apparatus according to claim 14 wherein each of said pins comprises a screw thread with a first pitch on its outer periphery, and said selective pressing means comprises pin position adjusting means having a screw thread with a second pitch for holding said pin and a cylindrical screw inserted between said pin and said pin position adjusting means and having a screw thread of the first pitch on the inner surface and a screw thread of the second pitch on the outer surface.

16. A polishing apparatus according to claim 13 wherein said buffer plate is formed of teflon or hard rubber.

17. A polishing apparatus according to claim 13 wherein said pressure container comprises a partition for disposing said selective pressing means outside said pressure container.

18. A method of polishing a wafer by pressing a surface of the wafer to be polished to a polishing surface and moving said surface to be polished and said polishing surface elatively, comprising the step of polishing while selectively applying a first pressure on one part of said wafer a second pressure on another part, the first pressure being larger than the second by a selected amount.

19. A method of polishing a wafer according to claim 18 wherein said one part is a region of said surface to be polished excluding a peripheral portion.

20. A method of polishing a wafer by pressing a surface of the wafer to be polished to a polishing surface and moving said surface to be polished and said polishing surface relatively, comprising the step of polishing while selectively applying different pressures to a plate formed of an elastic material on a back surface of a wafer to be polished.

21. A method of polishing a wafer by pressing a surface of the wafer to be polished to a polishing surface and moving said surface to be polished and said polishing surface relatively, comprising the steps of moving said surface of the wafer to be polished gradually nearer to said polishing surface and fixing a relative distance between the surfaces at the time of contact of the surfaces; and polishing the surface to be polished, while selectively applying different pressures to the wafer from a back surface thereof so as to define different pressure regions.

* * * * *